US005865240A

United States Patent [19]

Asuke

[11] Patent Number: 5,865,240

[45] Date of Patent: Feb. 2, 1999

[54] RHEOCASTING METHOD AND APPARATUS

[75] Inventor: Fumio Asuke, Ushiku, Japan

[73] Assignee: Agency of Industrial Science & Technology, Ministry of International Trade & Industry, Tokyo, Japan

[21] Appl. No.: 832,361

[22] Filed: Apr. 2, 1997

[30] Foreign Application Priority Data

Apr. 5, 1996 [JP] Japan ..... 8-110189

[51] Int. Cl.[6] ..... B22D 1/00; B22D 35/00

[52] U.S. Cl. ..... 164/133; 164/900; 164/71.1; 420/590; 75/10.65

[58] Field of Search ..... 164/900, 71.1, 164/133; 420/590; 75/10.65

[56] References Cited

U.S. PATENT DOCUMENTS 1,866,682 7/1932 Temmen ..... 164/133

FOREIGN PATENT DOCUMENTS 732073 5/1980 U.S.S.R. ..... 164/900

*Primary Examiner*—Kuang Y. Lin

*Attorney, Agent, or Firm*—Oblon, Spivak, McClelland, Maier & Neustadt, P.C.

[57] ABSTRACT

Rheocasting is effected by an apparatus that comprises a melt tank, a temperature-controllable stirrer that is immersed in a melt contained in the melt tank and can stir the melt, a screw conveyor apparatus that can draw off metal in a semi-solid state contained in the melt tank. Vertical melt separation grooves on the inside of the conveyor apparatus enable the semi-solid into a semi-solid having a viscosity that is not less than a prescribed viscosity value and a semi-solid having a viscosity that is less than the prescribed viscosity value.

3 Claims, 1 Drawing Sheet

RHEOCASTING METHOD AND APPARATUS

BACKGROUND OF THE INVENTION

1. Field of the Invention

This invention relates to a continuous rheocasting method and to an apparatus that implements the continuous rheocasting.

2. Description of the Prior Art

Refining the size of metal crystal grains is one technique that is used to enhance the properties of cast metal materials. In the rheocasting method, a melt is cooled while at the same time being subjected to mechanical or ultrasonic agitation to uniformly diffuse fine solid-phase nuclei in the melt to produce a semi-solid. However, in the conventional technology the viscosity of the semi-solid was controlled by controlling the temperature of the metal. Thus, stirring the melt and at the same time adjusting the viscosity while controlling the temperature to draw off a metal semi-solid is a task of considerable difficulty.

An object of the present invention is to provide rheocasting method and apparatus that enable a metal semi-solid to be readily drawn off while the semi-solid is being simultaneously subjected to stirring and adjustment of the viscosity of the semi-solid.

SUMMARY OF THE INVENTION

For achieving the object, the invention provides a continuous rheocasting method, comprising using a stirring apparatus to cool a temperature-adjusted melt while stirring the melt to produce a semi-solid of metal, and separating the semi-solid into a semi-solid having a viscosity that is not less than a prescribed viscosity value and a semi-solid having a viscosity that is less than the prescribed viscosity value.

For achieving the object, the invention also provides a rheocasting apparatus, comprising: a melt tank for containing a melt, a temperature-controllable stirrer that is immersed in a melt contained in the melt tank and can stir the melt in which the stirrer is immersed, a conveyor apparatus that can draw off metal in a semi-solid state contained in the melt tank, and plural melt separation grooves whereby the conveyer apparatus separates the semi-solid into a semi-solid having a viscosity that is not less than a prescribed viscosity value and a semi-solid having a viscosity that is less than the prescribed viscosity value.

The rheocasting method according to the present invention uses a stirring apparatus to subject the melt simultaneously to localized cooling and stirring to thereby produce a semi-solid state having a high content of fine crystal grain nuclei. A conveyor apparatus is used that automatically and continuously separates the semi-solid into a semi-solid having a viscosity that is not less than a prescribed viscosity value and a semi-solid having a viscosity that is less than the prescribed viscosity value by means of melt separation grooves.

Further features of the invention, its nature and various advantages will be more apparent from the accompanying drawings and following detailed description of the invention.

DESCRIPTION OF THE PREFERRED EMBODIMENT

Figure 1:
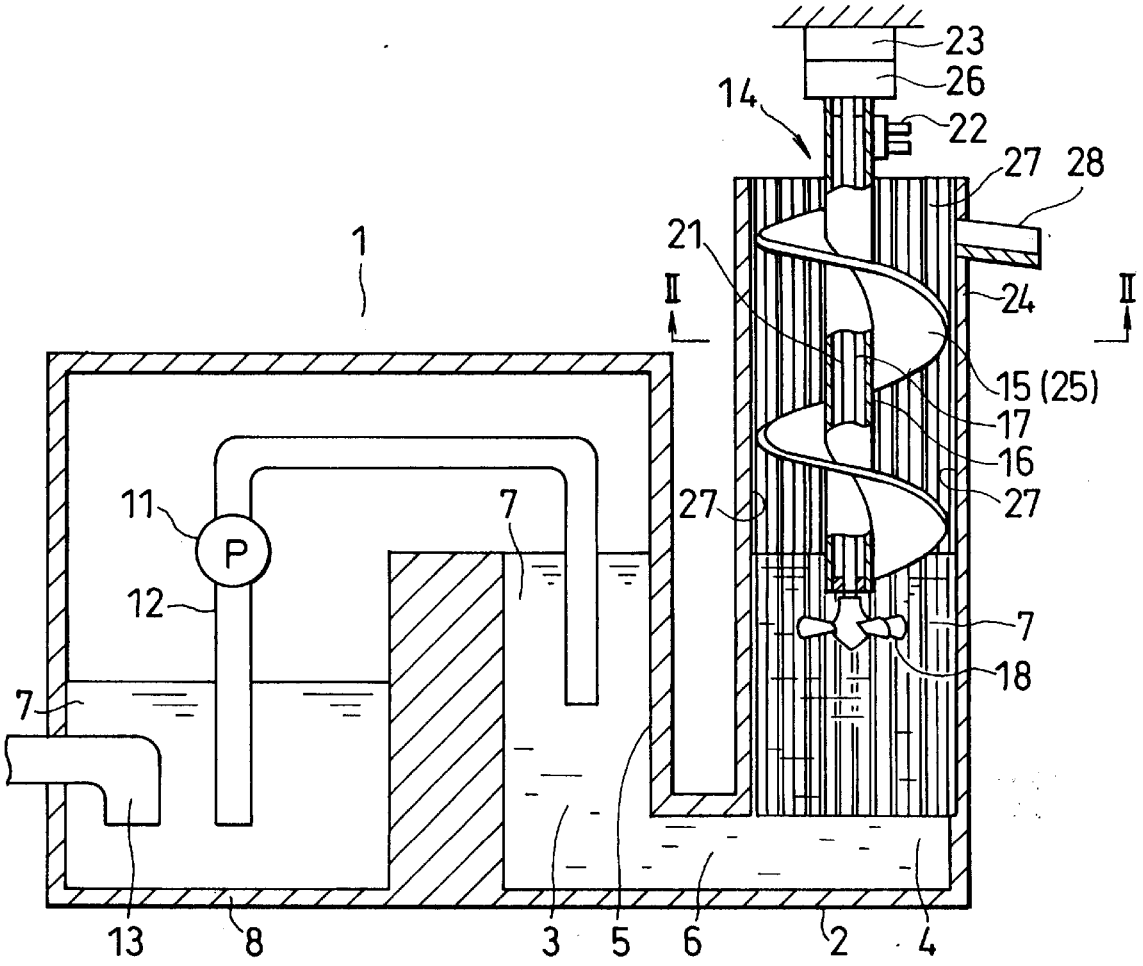
FIG. 1 is an explanatory view showing the configuration of a continuous rheocasting apparatus according to the present invention.
Figure 2:
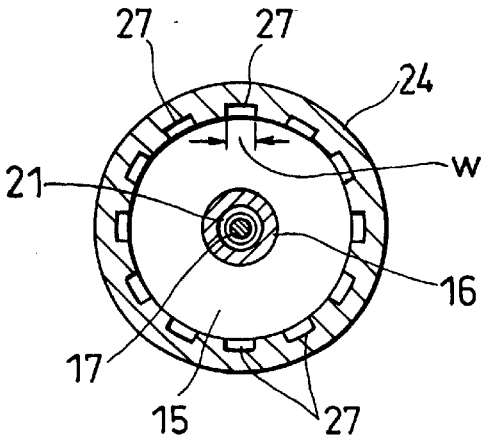
FIG. 2 is a cross section taken along line II—II in FIG. 1.

FIG. 1 is a diagram of a continuous rheocasting apparatus 1 that is an embodiment of the invention. The continuous rheocasting apparatus 1 has a melt tank 2, which has a melt input tank 3 and a stirring tank 4. The melt input tank 3 and stirring tank 4 are connected by a passage 6 formed beneath a baffle 5, so that a melt 7 fills both tanks. The melt tank 2 is situated adjacent to an initial tank 8 from which a pump 11 supplies melt 7 to the melt tank 2 via a pipe 12. The melt 7 is supplied from an external source to the initial tank 8 via a pipe 13. The melt input tank 3, stirring tank 4 and initial tank 8 are provided with a temperature adjusting apparatus (not shown) for maintaining the melt 7 at a prescribed temperature. A stirrer 14 and a conveyor 15 are disposed above the stirring tank 4. The stirrer 14 has a vertical hollow shaft 16, within which there is a rotating spindle 17. The spindle 17 has a stirrer blade 18 that is attached to the lower end of the spindle 17 at a position where the stirrer blade 18 is immersed in the melt 7. The spindle 17 and the stirrer blade 18 can transmit heat. There is an annular space between the hollow shaft 16 and the spindle 17 that forms a coolant channel 21 for a coolant such as water. Namely, the coolant channel 21 is in the form of a double-walled pipe as shown in FIG. 2. Water used as the coolant is supplied via coolant manifold 22 to the inner part of the coolant channel 21, that is, to the spindle 17, to cool the spindle 17. Cooling the spindle 17 cools the stirrer blade 18. The water used to cool the spindle 17 passes back to the coolant manifold 22 via the outer part of the coolant channel 21. The spindle 17 is rotated by a turning gear 23.

The conveyor 15 has an outer cylinder 24 and a screw conveyer 25 that is closely fitted inside the outer cylinder 24. The screw conveyer 25 is attached around the hollow shaft 16. The hollow shaft 16 is rotated by a drive 26. Multiple vertical melt separation grooves 27 are formed around the inside face of the outer cylinder 24. The viscosity of the metal melt 7 and semi-solid depends on the width and depth of the melt separation grooves 27. The outer cylinder 24 is heated to a temperature close to the melting point of the metal concerned (the heating means is not shown). There is no particular limitation on the metal used in this invention, with suitable metals including aluminum, ferrous metals and copper.

Using the continuous rheocasting apparatus 1 thus configured as described, continuous rheocasting is carried out as follows. The melt 7 is supplied to the initial tank 8 via the pipe 13. The pump 11 is used to maintain a constant supply of the melt 7 from the initial tank 8 to the melt tank 2, via the pipe 12 so that the melt tank 2 is always in a state of overflow. The result is that the level of the melt 7 in the stirring tank 4 is maintained at a constant height. The melt 7 in the stirring tank 4 is stirred by rotating the stirrer blade 18. At this time a heat-transmission relationship exists between the spindle 17 and the stirrer blade 18. Via the coolant manifold 22, cooling water is supplied to the coolant channel 21 between the hollow shaft 16 and the spindle 17, whereby the stirrer blade 18 is cooled via the spindle 17. Consequently, while stirring proceeds localized cooling of the melt 7 takes place in the vicinity of the stirrer blade 18, suppressing growth of nuclei and forming a semi-solid of metal in which fine solid-phase nuclei are uniformly dispersed. This semi-solid of metal is conveyed up inside the outer cylinder 24 by the screw conveyer 25 until it is discharged via an outlet 28. The molten metal conveyed upward by the screw conveyer 25 comprises the melt 7 mixed with metal in a low-viscosity semi-solid state. This mixture automatically flows down along the melt separation grooves 27, and as a result, only metal having a prescribed viscosity is conveyed as far as the outlet 28. In this way, the required melt 7 viscosity is automatically selected so that only metal in a semi-solid state having the required viscosity is selectively and continuously drawn off. The viscosity of the semi-solid that can flow down the melt separation grooves 27 is determined by the width w of the melt separation grooves 27, the depth, the number of grooves and so forth.

Thus, as described in the foregoing, the melt 7 from the initial tank 8 is supplied to the melt input tank 3 so that the melt input tank 3 is constantly in a state of overflow. Therefore, even if metal in a semi-solid state is discharged by the action of the screw conveyer 25, the level of the melt in the stirring tank 4 remains the same, readily enabling a metal semi-solid of the required viscosity to be continuously drawn off. As such, in accordance with the present invention a continuous rheocasting apparatus is provided that enables a metal semi-solid to be readily drawn off while the semi-solid is being stirred while at the same time the viscosity of the semi-solid is being adjusted.

What is claimed is:

1. A continuous rheocasting method comprising the steps of:

cooling a melt while stirring the melt by a temperature-adjusted stirring apparatus to produce a semi-solid of metal in the melt;

conveying the melt containing the semi-solid of metal upward inside an outer cylinder by a screw conveyor rotating inside the outer cylinder;

separating the melt containing the semi-solid of metal into a semi-solid of metal having a viscosity that is not less than a prescribed viscosity value and a second melt containing a semi-solid of metal having a viscosity that is less than the prescribed viscosity value by allowing the second melt to flow down along a plurality of melt separation grooves provided on an inside surface of the outer cylinder; and recovering the separated semi-solid of metal having, the viscosity that is not less than the prescribed viscosity value.

2. A rheocasting apparatus comprising:

a stirring tank for containing a melt;

a temperature-controllable stirrer that is immersed in a melt contained in the stirring tank and can stir the melt in which the stirrer is immersed;

an outer cylinder provided on the stirring tank and having a plurality of melt separation grooves formed around an inside surface of the outer cylinder and an outlet formed in an upper portion of the outer cylinder; and a screw conveyor rotating inside the outer cylinder conveying a semi-solid of metal having a viscosity that is not less than a prescribed viscosity value upward inside the outer cylinder, and discharging the conveyed semi-solid of metal via the outlet.

3. A rheocasting apparatus according to claim 2, wherein the stirrer is a cooled stirring blade.

* * * * *